US006510826B2

(12) United States Patent
Watanabe

(10) Patent No.: US 6,510,826 B2
(45) Date of Patent: Jan. 28, 2003

(54) VALVE TIMING CONTROL DEVICE OF INTERNAL COMBUSTION ENGINE

(75) Inventor: Masahiko Watanabe, Yokohama (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 10/046,826

(22) Filed: Jan. 17, 2002

(65) Prior Publication Data

US 2002/0100446 A1 Aug. 1, 2002

(30) Foreign Application Priority Data

Jan. 31, 2001 (JP) ..... 2001-024079

(51) Int. Cl.[7] ..... F01L 1/344
(52) U.S. Cl. ..... 123/90.17
(58) Field of Search ..... 123/90.15, 90.17, 123/90.31

(56) References Cited

U.S. PATENT DOCUMENTS 5,031,585 A * 7/1991 Muir et al. ..... 123/90.17
5,172,661 A * 12/1992 Brune et al. ..... 123/90.17
5,305,719 A * 4/1994 Clarke et al. ..... 123/90.17
5,381,764 A * 1/1995 Fukuma et al. ..... 123/90.17
6,129,061 A * 10/2000 Okuda et al. ..... 123/90.17
6,328,008 B1 * 12/2001 Io ..... 123/90.17
6,390,045 B1 * 5/2002 Mae et al. ..... 123/90.17

FOREIGN PATENT DOCUMENTS

JP 10-153104 6/1998
JP 2001-41013 2/2001

* cited by examiner

*Primary Examiner*—Weilun Lo
(74) *Attorney, Agent, or Firm*—Foley & Lardner

(57) ABSTRACT

A drive rotation member is rotated about a given axis by a crankshaft of the engine, and a driven rotation member is rotated about the given axis together with a camshaft of the engine. A relative rotation angle control mechanism is arranged through which the drive and driven rotation members are coaxially connected. The relative rotation angle control mechanism has a movable control member which, when applied with an operation force from an actuation device, varies a relative rotation angle between the drive and driven rotation members. The actuation device comprises a first electromagnetic brake which applies an operation force to the movable control member to cause a rotation of the driven rotation member to be shifted in one of advancing and retarding directions with respect to a rotation of the drive rotation member, and a second electromagnetic brake which applies an operation force to the movable control member to cause the rotation of the driven rotation member to be shifted in the other of the advancing and retarding directions with respect to the rotation of the drive rotation member.

13 Claims, 8 Drawing Sheets

VALVE TIMING CONTROL DEVICE OF INTERNAL COMBUSTION ENGINE

BACKGROUND OF THE INVENTION

1. Field of the Invention

The present invention relates in general to a control device for controlling operation of an internal combustion engine, and more particularly to a valve timing control device which controls or varies an open/close timing of intake and/or exhaust valves of the internal combustion engine in accordance with an operation condition of the engine.

2. Description of the Related Art

In order to clarify the task of the present invention, one valve timing control device of an internal combustion engine will be briefly described, which is shown in Laid-open Japanese Patent Application (Tokkai-hei) 10-153104.

In the valve timing control device of the publication, a timing pulley driven by a crankshaft of the engine is rotatably disposed around a shaft member which is integrally connected to a camshaft. A so-called "relative rotation angle control mechanism" is arranged between the timing pulley and the shaft member. The relative rotation angle control mechanism comprises generally a piston member which is axially movably connected to the timing pulley while being suppressed from rotating about an axis thereof relative to the timing pulley, a first helical gear which is formed on a cylindrical inner surface of the piston member, a second helical gear which is formed on a cylindrical outer surface of the shaft member and meshed with the first helical gear and an electric actuator which moves the piston member axially. The electric actuator comprises electromagnets and a return spring. That is, by moving the piston member forward or rearward to a desired position by the electric actuator, a relative rotation angle between the timing pulley and the shaft member is controlled or varied.

However, in the above-mentioned valve timing control device of the publication, due to the arrangement wherein the piston member is moved forward or rearward along the axis of the camshaft, the parts arranged at the front end of the camshaft need an axially enlarged mounting space thereof, which brings about an increase in length of the engine. In fact, the electromagnets of the electric actuator arranged at an axially outside area of the piston member induce a major cause of the increase of the axially enlarged mounting space of the valve timing control device.

For solving such shortcoming of the 10-153104 publication, various measures have been proposed and put into practical use. Some of them are of a type employing an electromagnetic brake which, when energized, produces a braking force for braking a movable part of the valve timing control device to provide the camshaft with an adjusted (viz., advanced/retarded) rotation angle relative to the crankshaft. However, in some of them, usage of such electromagnetic brake has induced a wasteful electric power consumption of the vehicle.

SUMMARY OF THE INVENTION

It is therefore an object of the present invention to provide a valve timing control device of an internal combustion engine, which is free of the above-mentioned drawbacks.

That is, according to the present invention, there is provided a valve timing control device of an internal combustion engine, which can reduce or save an electric power consumed by an electromagnetic brake employed for applying an operation force to a movable control member of the valve timing control device.

According to a first aspect of the present invention, there is provided a valve timing control device of an internal combustion engine, which comprises a drive rotation member rotated about a given axis by a crankshaft of the engine; a driven rotation member rotated about a given axis together with a camshaft of the engine; a relative rotation angle control mechanism through which the drive and driven rotation members are coaxially connected, the relative rotation angle control mechanism having a movable control member which, when applied with an operation force from an actuation device, varies a relative rotation angle between the drive and driven rotation members, the actuation device comprising a first electromagnetic brake which applies an operation force to the movable control member to cause a rotation of the driven rotation member to be shifted in one of advancing and retarding directions with respect to a rotation of the drive rotation member; and a second electromagnetic brake which applies a operation force to the movable control member to cause the rotation of the driven rotation member to be shifted in the other of the advancing and retarding directions with respect to the rotation of the drive rotation member.

According to a second aspect of the present invention, there is provided a valve timing control device of an internal combustion engine, which comprises a drive rotation member rotated about a given axis by a crankshaft of the engine; a driven rotation member rotated about the given axis together with a camshaft of the engine; a relative rotation angle control mechanism through which the drive and driven rotation members are coaxially connected, the relative rotation angle control mechanism having a movable control member which, when radially moved by receiving an operation force, varies a relative rotation angle between the drive and driven rotation members; and an actuation device which applies an operation force to the movable control member, the actuation device comprising a first electromagnetic brake which applies an operation force to the movable control member to cause a rotation of the driven rotation member to be shifted in one of advancing and retarding directions with respect to a rotation of the drive rotation member; and a second electromagnetic brake which applies a operation force to the movable control member to cause the rotation of the driven rotation member to be shifted in the other of the advancing and retarding directions with respect to the rotation of the drive rotation member, the relative rotation angle control mechanism comprising an intermediate rotation member rotatable about the given axis relative to both the drive and driven rotation members, the intermediate rotation member being formed with a spiral guide with which the movable control member is slidably engaged, so that rotation of the intermediate rotation member induces the radial movement of the movable control member.

According to a third aspect of the present invention, there is provided a valve timing control device of an internal combustion engine, which comprises a drive rotation member rotated about a given axis by a crankshaft of the engine; a driven rotation member rotated about the given axis together with a camshaft of the engine; a relative rotation angle control mechanism through which the drive and driven rotation members are coaxially connected, the relative rotation angle control mechanism having a movable control member which, when radially moved by receiving an operation force, varies a relative rotation angle between the drive and driven rotation members; and an actuation device which applies an operation force to the movable control member, the actuation device comprising a first electromagnetic brake which applies an operation force to the movable control member to cause a rotation of the driven rotation member to be shifted in one of advancing and retarding directions with respect to a rotation of the drive rotation member; and a second electromagnetic brake which applies a operation force to the movable control member to cause the rotation of the driven rotation member to be shifted in the other of the advancing and retarding directions with respect to the rotation of the drive rotation member, the relative rotation angle control mechanism comprising an intermediate rotation member rotatable about the given axis relative to both the drive and driven rotation members, the intermediate rotation member being formed with a spiral guide with which the movable control member is slidably engaged, so that rotation of the intermediate rotation member induces the radial movement of the movable control member; and a link through which the movable control member is linked to a given portion of the driven rotation member, the given portion being positioned away from the given axis in a radial direction.

According to a fourth aspect of the present invention, there is provided a valve timing control device of an internal combustion engine, which comprises a drive rotation member rotated about a given axis by a crankshaft of the engine; a driven rotation member rotated about the given axis together with a camshaft of the engine; a relative rotation angle control mechanism through which the drive and driven rotation members are coaxially connected, the relative rotation angle control mechanism having a movable control member which, when radially moved by receiving an operation force, varies a relative rotation angle between the drive and driven rotation members; and an actuation device which applies an operation force to the movable control member, the actuation device comprising a first electromagnetic brake which applies an operation force to the movable control member to cause a rotation of the driven rotation member to be shifted in one of advancing and retarding directions with respect to a rotation of the drive rotation member; and a second electromagnetic brake which applies a operation force to the movable control member to cause the rotation of the driven rotation member to be shifted in the other of the advancing and retarding directions with respect to the rotation of the drive rotation member, the relative rotation angle control mechanism being so arranged that when both the first and second electromagnetic brakes of the actuation device become deenergized, a certain relative rotation angle is provided between the drive and driven rotation members, which is suitable for starting of the engine.

Other objects and features of the present invention will become apparent from the following description when taken in conjunction with the accompanying drawings.

DETAILED DESCRIPTION OF THE EMBODIMENTS

In the following, three embodiments of the present invention will be described in detail with reference to the accompanying drawings.

For ease of understanding, the following description will contain various directional terms, such as, left, right, upper, lower and the like. However, such terms are to be understood with respect to only a drawing or drawings on which the corresponding part or element is illustrated.

Referring to FIGS. 1 to 5 of the drawings, there is shown a valve timing control device 100 which is a first embodiment of the present invention.

Although the valve timing control device 100 is described as being applied to intake valves of an internal combustion engine, the device 100 can be also applied to exhaust valves of the engine.

Figure 1:
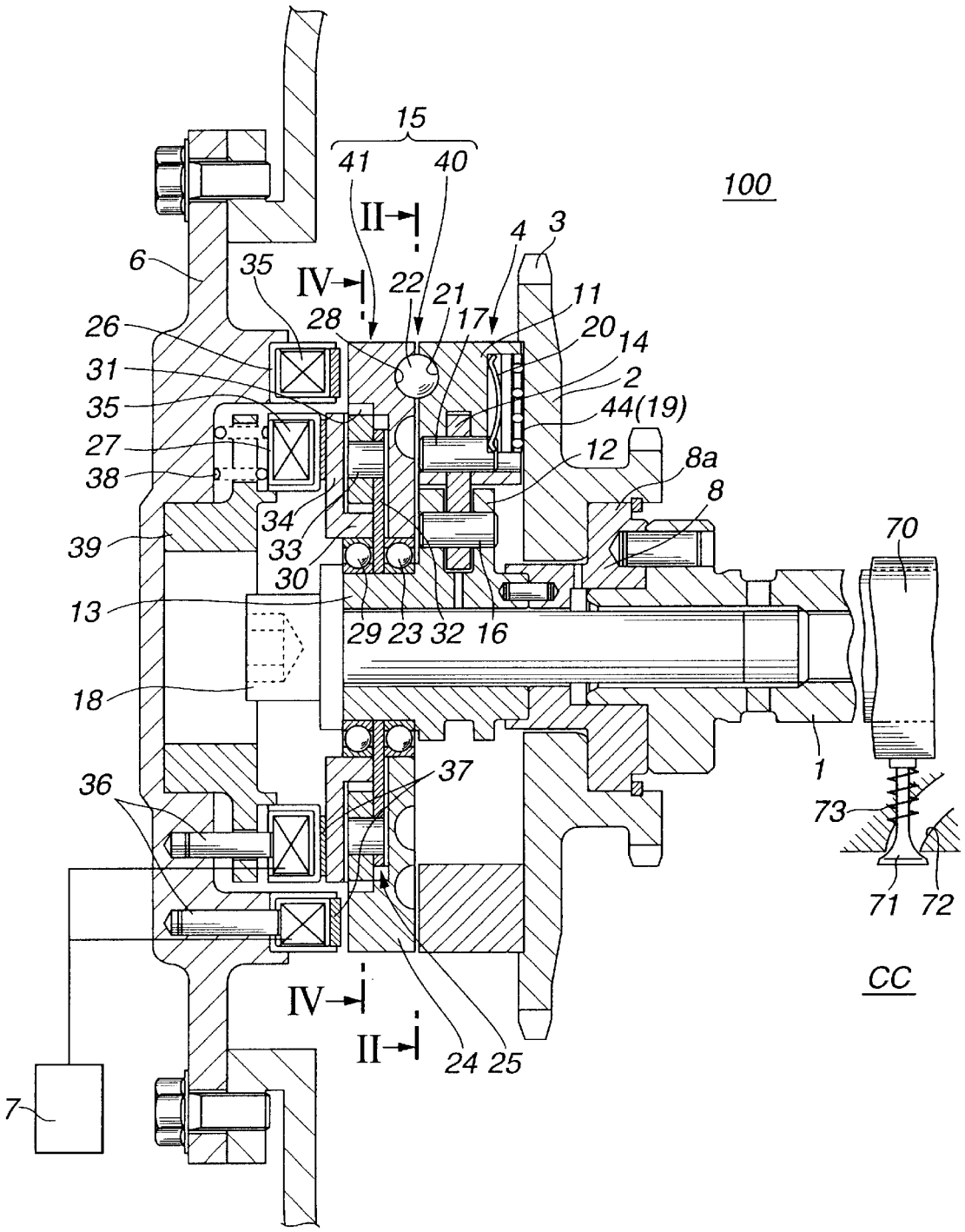
FIG. 1 is a sectional view of a valve timing control device which is a first embodiment of the present invention.

As is understood from FIG. 1, the valve timing control device 100 is arranged on a cylinder head which has a plurality of intake ports 72 (only one is shown) and a plurality of exhaust ports (not shown), each extending from an associated combustion chamber "CC" in a known manner. Each intake port 72 has an intake valve 71 which functions to open and close the intake port 72. Due to function of a valve spring 73, each intake valve 71 is biased in a direction to close the intake port 72. The intake valves 71 are driven by respective cams 70 provided on a camshaft 1 which is supported on the cylinder head in a manner to rotate about its axis.

Rotatably disposed around a front (viz., left) end portion of the camshaft 1 is a circular drive plate 2 (or drive wheel). The circular drive plate 2 is formed at its periphery with teeth 3 to constitute a timing sprocket and is driven or rotated by a crankshaft (not shown) of the engine.

At a front (viz., left) side of the camshaft 1 and the drive plate 2, there are arranged a relative rotation angle control mechanism 4 which varies a relative rotation angle between the camshaft 1 and the drive plate 2, an operating mechanism 15 which operates the relative rotation angle control mechanism 4 and a VTC cover 6 which is arranged to straddle front ends of the cylinder head and a rocker cover (not shown) in a manner to cover or conceal the drive plate 2, the relative rotation angle control mechanism 4 and the operating mechanism 15. Denoted by numeral 7 is a controller which controls the operating mechanism 15 in accordance with an operating condition of the engine.

To the front end of the camshaft 1, there is secured an annular spacer 8 which is formed with a stopper flange 8*a*. The drive plate 2 is rotatably disposed on the spacer 8 while being suppressed from making an axial movement by the stopper flange 8*a*.

It is to be noted that the camshaft 1 and the spacer 8 constitute a driven rotation member, and the drive plate 2 constitutes a drive rotation member.

Figure 2:
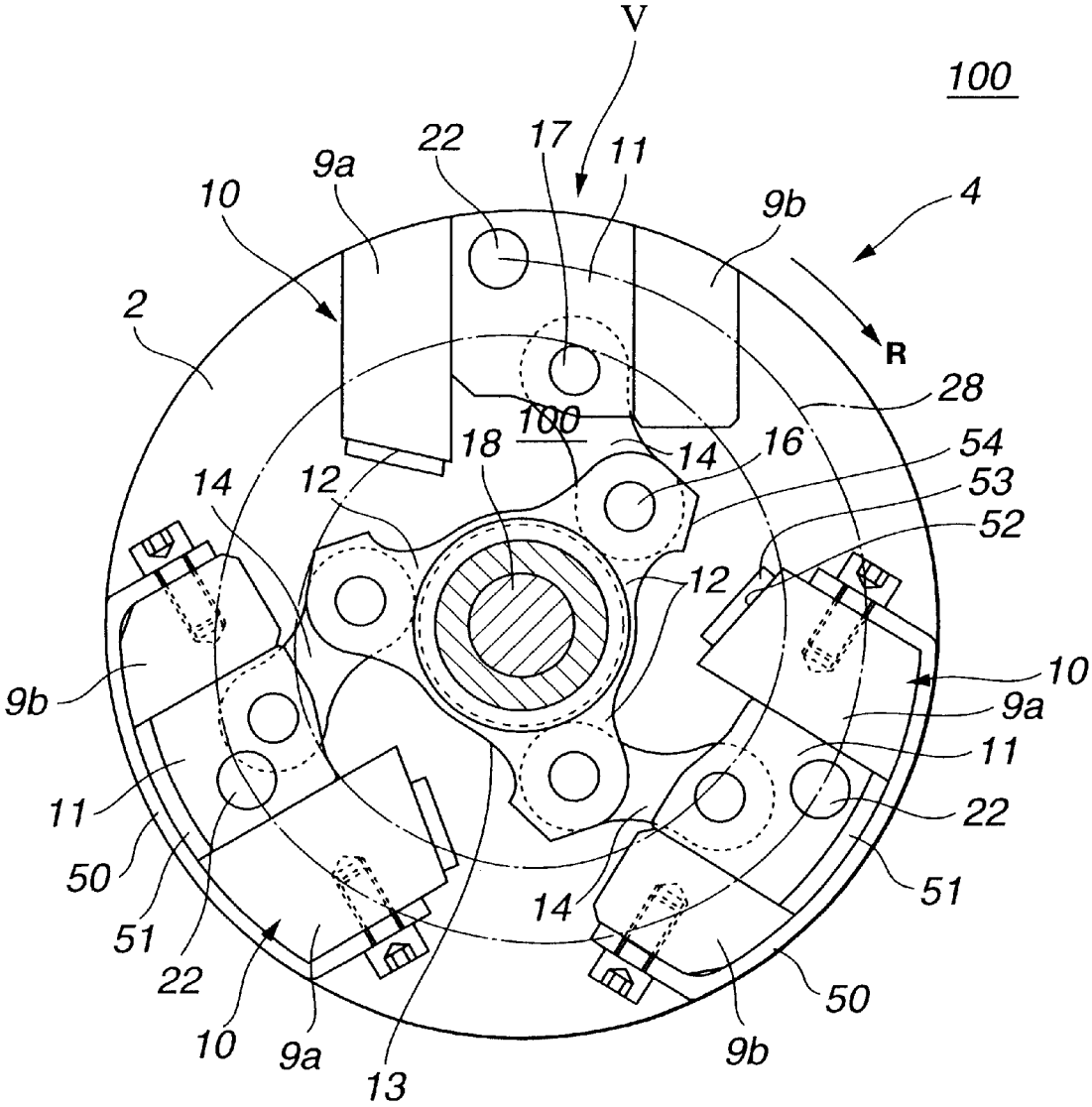
FIG. 2 is a sectional view taken along the line "II—II" of FIG. 1 showing the most-retarded angular position of a camshaft relative to a drive plate.

As is seen from FIG. 2, on the front surface of the drive plate 2, there are provided three radial guide units 10 which are arranged around an axis of the drive plate 2 at equally spaced intervals, each including a pair of parallel guide walls 9*a* and 9*b* between which a guide way is defined. As shown, the paired guide walls 9*a* and 9*b* of each radial guide unit 10 extend generally radially.

As will be described in detail hereinafter, between the paired guide walls 9*a* and 9*b* of each radial guide unit 10, that is, on the guide way, there is radially slidably disposed a sliding member 11.

It is now to be noted that the radial guide unit 10 is not limited to such a unit having parallel guide walls 9*a* and 9*b* that extend exactly in a radial direction. That is, the radial guide unit 10 may be constructed to guide the sliding member 11 in a generally radial direction.

As is seen from FIGS. 1 and 2, the relative rotation angle control mechanism 4 is incorporated with a lever shaft 13 which is coaxially connected to the left end (as viewed in FIG. 1) of the camshaft 1 together with the spacer 8 by means of a bolt 18.

As is seen from FIG. 2, the lever shaft 13 is integrally formed with three radial levers 12 which are arranged at evenly spaced intervals.

The relative rotation angle control mechanism 4 has three sliding members 11, each being radially slidably disposed between the above-mentioned paired guide walls 9*a* and 9*b* of the corresponding radial guide unit 10. The sliding members 11 are each shaped generally rectangular. The three radial levers 12 of the lever shaft 13 are pivotally and respectively connected to the three sliding members 11 by means of three link arms 14. That is, each of the link arms 14 has an inner end pivotally connected to the corresponding lever 12 through a pivot pin 16 and an outer end pivotally connected to the corresponding sliding member 11 through a pivot pin 17.

As is described hereinabove and as is easily understood from FIGS. 1 and 2, each of the sliding members 11 is radially movably guided by the corresponding radial guide unit 10, and is connected to the camshaft 1 through the link arm 14 and the lever 12 of the lever shaft 13. Thus, when, upon receiving an external force, the sliding members 11 are moved radially outward or inward along the respective guide units 10, the link mechanism including the sliding members 11, the link arms 14 and the levers 12 brings about a relative rotation between the drive plate 2 and the camshaft 1 by an angle corresponding to the radial displacement of the sliding members 11.

It is now to be noted that if each sliding member 11 is constructed swingable in the guide unit 10, the sliding member 11 and the corresponding link arm 14 may be integrally formed into a single part. More specifically, in this modification, each sliding member 11 is cylindrical in shape and rotatably slidable in the guide way defined between the parallel guide walls 9*a* and 9*b* of the guide unit 10.

As is seen from FIG. 1, each sliding member 11 is equipped at a rear side thereof with a radially movable roller unit 44 which is biased toward the drive plate 2 by a plate spring 20. The roller unit 44 has a plurality of rollers 19 installed therein.

Figure 5:
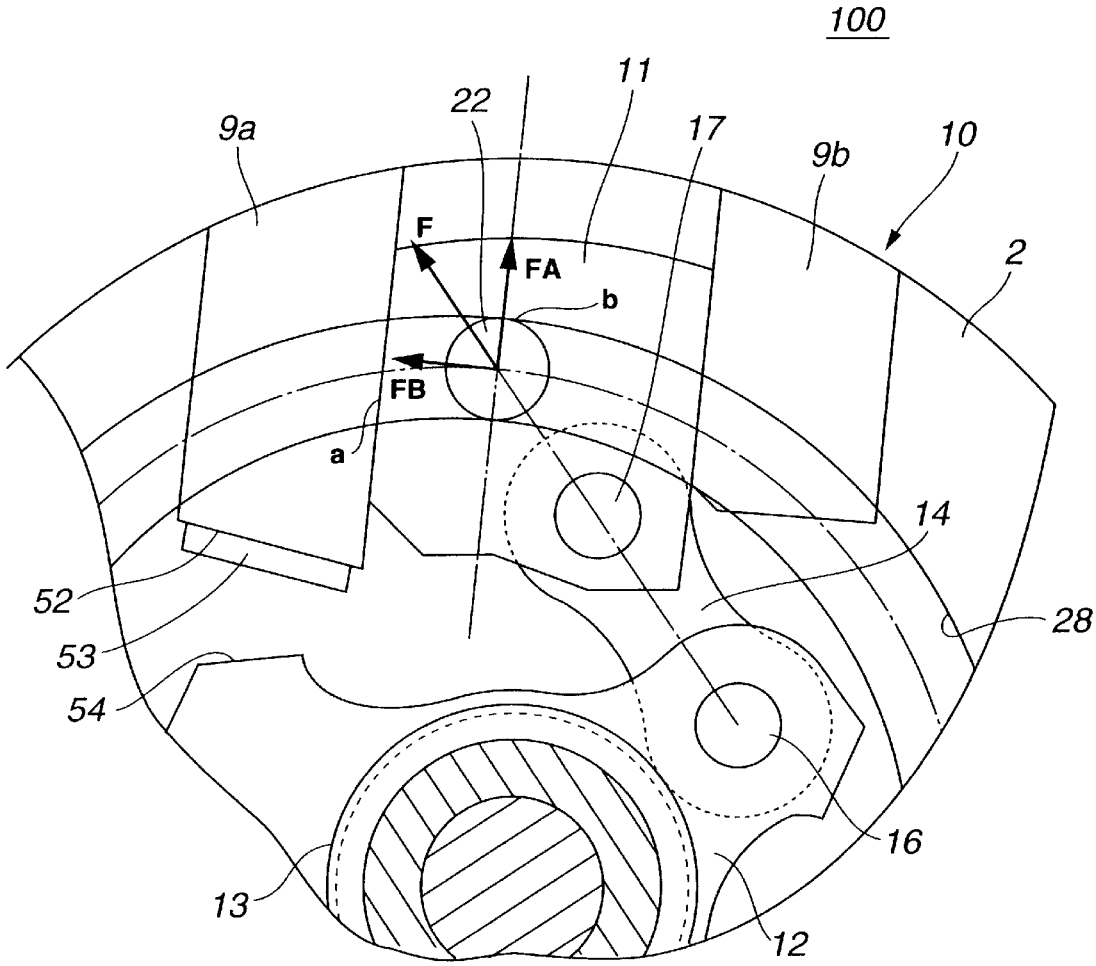
FIG. 5 is an enlarged sectional view of a portion indicated by the arrow "V" in FIG. 2.

As is easily seen from FIGS. 1, 2 and 5, each sliding member 11 is formed on a front surface thereof with a semi-spherical recess 21 in which a half part of a rolling ball 22 is received. Due to provision of the above-mentioned spring plate 20, the sliding member 11 is biased toward the rolling ball 22.

As is understood from FIG. 1, a circular guide plate 24 is rotatably disposed on a front (or left) end portion of the lever shaft 13 through a bearing 23.

An operation conversing mechanism 40 is employed which, when the guide plate 24 and the drive plate 2 make a relative rotation therebetween, moves the sliding members 11 radially outward or inward by a degree corresponding to the relative rotation.

A guide plate actuating mechanism 41 is further employed, which forces the guide plate 24 to take a desired rotation angle relative to the guide units 10, that is, relative to the drive plate 2.

The operation converging mechanism 40 comprises the three rolling balls 22 held by the sliding members 11, and the guide plate 24.

As is seen from FIGS. 1 and 2, the guide plate 24 is formed on its rear surface with a concentric spiral guide groove 28 in which the rolling balls 22 are slidably, rotatably and partially received. As is seen from FIG. 1, the spiral guide groove 28 has a semi-circular cross section.

As is seen from FIG. 2, the spiral guide groove 28 is shaped so as to gradually reduce its radius as it advances in the direction of the arrow "R". Accordingly, when, with the rolling balls 22 kept received in the spiral guide groove 28, the guide plate 24 makes a rotation in a retarding direction relative to the drive plate 2, each siding member 11 is moved radially inward along the guide walls 9*a* and 9*b* of the guide unit 10 while sliding in and along the spiral guide groove 28. While, when the guide plate 24 makes a rotation in an advancing direction relative to the drive plate 2, the sliding member 11 is moved radially outward along the guide walls 9*a* and 9*b* while sliding in and along the spiral guide groove 28.

Figure 4:
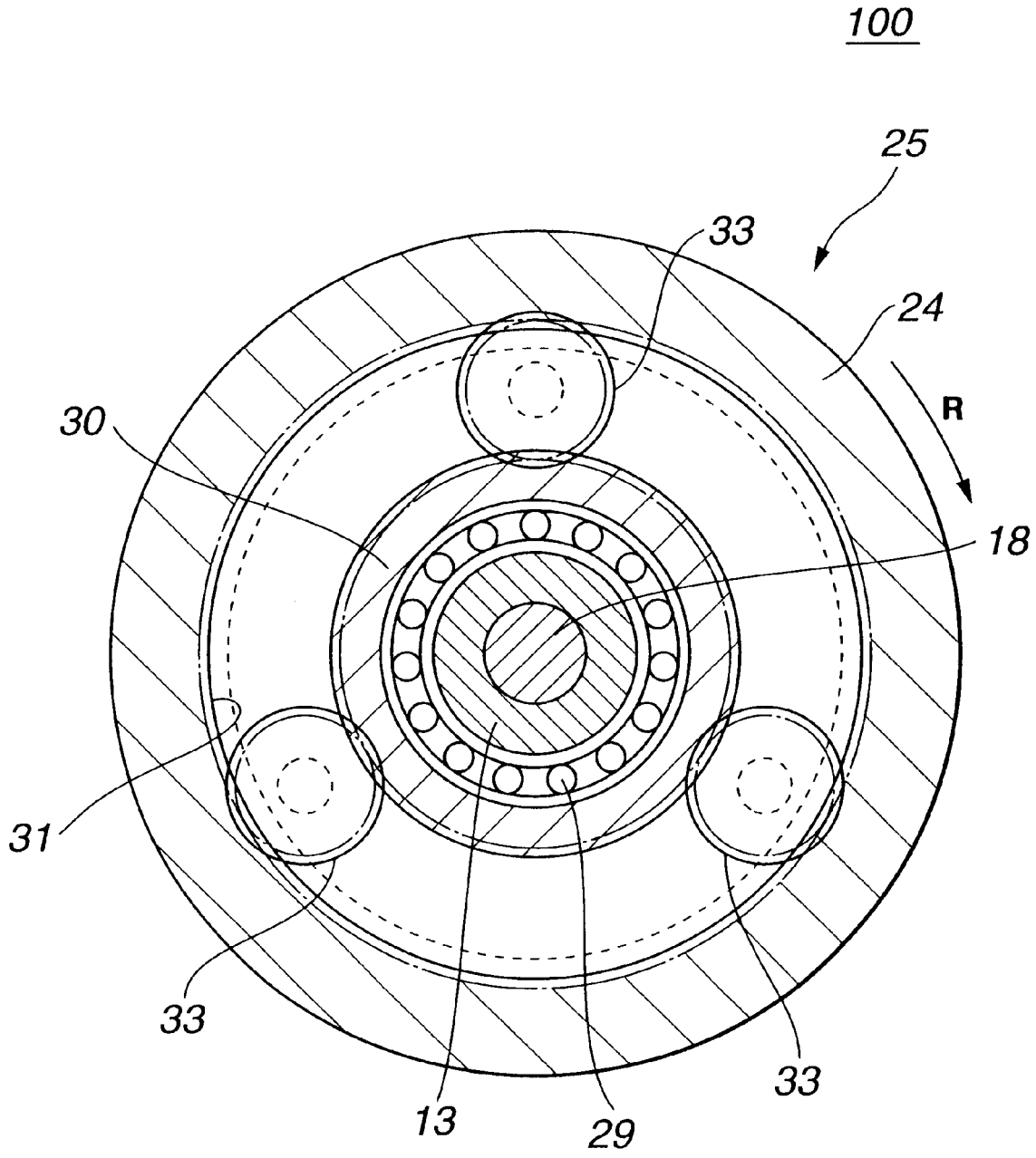
FIG. 4 is a sectional view taken along the line "IV—IV" of FIG. 1.

As is seen from FIGS. 1 and 4, the guide plate actuating mechanism 41 has a planetary gear unit 25 and first and second electromagnetic brakes 26 and 27.

The planetary gear unit 25 comprises a sun gear 30 which is rotatably disposed on a front end of the lever shaft 13 through a bearing 29, a ring gear 31 which is formed on an inner surface of a cylindrical recess formed in a front side of the guide plate 24, a carrier plate 32 which is secured to the lever shaft 13 at a position between the bearings 23 and 29, and three pinion gears 33 which are rotatably supported by the carrier plate 32 and meshed with both the sun gear 30 and ring gear 31.

Thus, when, with the sun gear 30 kept free, the pinion gears 33 are turned around an axis of the lever shaft 13 together with the carrier plate 32 without rotation thereof, the sun gear 30 and the ring gear 31 are rotated about the axis at the same speed. And, when, under this condition, a braking force is applied to only the sun gear 30, the sun gear 30 is forced to make a rotation in a retarding direction relative to the carrier plate 32 causing rotation of each pinion gear 33 resulting in that the ring gear 31 is accelerated turning the guide plate 24 in a speed advancing direction relative to the drive plate 2.

Referring back to FIG. 1, the first and second electromagnetic brakes 26 and 27 of the guide plate actuating mechanism 41 are both annular in shape. As shown, the second electromagnetic brake 27 is concentrically arranged in the first electromagnetic brake 26. The first and second electromagnetic brakes 26 and 27 have substantially the same construction. The first electromagnetic brake 26 is arranged to face a peripheral part of the front surface of the guide plate 24, and the second electromagnetic brake 27 is arranged to face an annular brake flange 34 integral with the sun gear 30. As shown, the annular brake flange 34 extends radially outward from the front end of the sun gear 30 in a manner to conceal the pinion gears 33.

Each of the first and second electromagnetic brakes 26 and 27 comprises an annular magnetic force generating core 35 which is loosely held by pins 36 secured to a rear side of the VTC cover 6 and an annular friction pad 37 which is attached to a rear side of the core 35. The magnetic force generating core 35 comprises an annular coil and an annular yoke which are coupled. When, in the first electromagnetic brake 26, the magnetic force generating core 35 is energized, the friction pad 37 is forced to contact the guide plate 24 to brake the same. As shown, in only the second electromagnetic brake 27, a spring 38 is employed for biasing the magnetic force generating core 35 toward the brake flange 34. Thus, in the second electromagnetic brake 27, the friction pad 37 is kept in contact with the brake flange 34 when the magnetic force generating core 35 is not energized. That is, when, in the second electromagnetic brake 27, the core 35 is energized, the friction pad 37 is released from the brake flange 34 against the force of the spring 38. Thus, when an associated internal combustion engine is at a standstill and/or an electric system of the engine fails to operate, a certain braking force can be applied to the sun gear 30 through the brake flange 34 by the second electromagnetic brake 27.

An axial movement of the magnetic force generating core 35 of the second electromagnetic brake 27 is guided by a retainer ring 39 which is secured to a rear surface of the VTC cover 6. The retainer ring 39 is constructed of magnetic material, and thus the ring 39 can provide a path for magnaflux produced when the core 35 of the second electromagnetic brake 27 is energized.

From the drive plate 2 to the camshaft 1, there is transmitted a drive force or torque through the sliding members 11, the link arms 14 and the levers 12 of the lever shaft 13. While, from the camshaft 1 to the sliding members 11, there is inputted the variable torque (or alternating torque) of the camshaft 1 through the levers 12 of the lever shaft 13 and the link arms 14. The variable torque is caused by a counterforce of each intake valve 71 (viz., a counterforce caused by the force of each valve spring 73).

More specifically, as is seen from FIG. 5, the variable torque applied to each sliding member 11 is a force "F" having a direction which passes through both one pivot point 16 between the lever 12 and the link arm 14 and the other pivot point 17 between the sliding member 11 and the link arm 14.

As is described hereinabove, each sliding member 11 is guided by the corresponding radial guide unit 10 in a manner to move radially, and due to provision of the rolling ball 22 having a half part received in the semi-spherical recess 21 of the sliding member 11 and the other half part received in the spiral guide groove 28 of the guide plate 24 (or guide wheel), the force "F" applied to each sliding member 11 from the leading end of the corresponding lever 12 through the corresponding link arm 14 is substantially received or supported by both the guide walls 9*a* and 9*b* of the guide unit 10 and the spiral guide groove 28 of the guide plate 24.

As is understood from FIG. 5, the guide walls 9*a* and 9*b* of each guide unit 10 are inclined rightward, that is, in a direction in which the spiral guide groove 28 converges with respect to a radial direction of the drive plate 2. More specifically, as shown, the guide walls 9*a* and 9*b* extend in a direction substantially normal to the curve of the spiral guide groove 28. Accordingly, the guide walls 9*a* and 9*b* intersect with the spiral guide groove 28 at generally right angles, and thus, a side surface "a" of the sliding member 11 contacting the guide wall 9*a* or 9*b* and a surface "b" defined on the rolling ball 11 intersect with each other at generally right angles.

Accordingly, the force "F" inputted to each sliding member 11 is divided into two components "$F_A$" and "$F_B$" which intersect at right angles, and thus these two components "$F_A$" and "$F_B$" are assuredly received by the outer wall of the spiral guide groove 28 and the guide wall 9*a* at generally right angles, respectively.

Under this condition, movement of each sliding member 11 is assuredly suppressed. Accordingly, once the sliding members 11 have been moved to predetermined radial positions due to the work of the braking force produced by the first and second electromagnetic brakes 26 and 27, the sliding members 11 can keep their positions even if the braking force is released from them. That is, once the sliding members 11 have come to the predetermined positions changing the phase of rotation of the camshaft 1, the changed phase of the camshaft 1 can be maintained without the aid of the braking force produced by the brakes 26 and 27.

As is understood from FIG. 5, when the force "F" is of a character that pulls the sliding member 11 radially inward by the lever 12, two components ("$F_A$" and "$F_B$") of the force "F" are assuredly received by an inner wall of the spiral guide groove 28 and the other guide wall 9*b* at generally right angles, like in the above-mentioned case.

Figure 3:
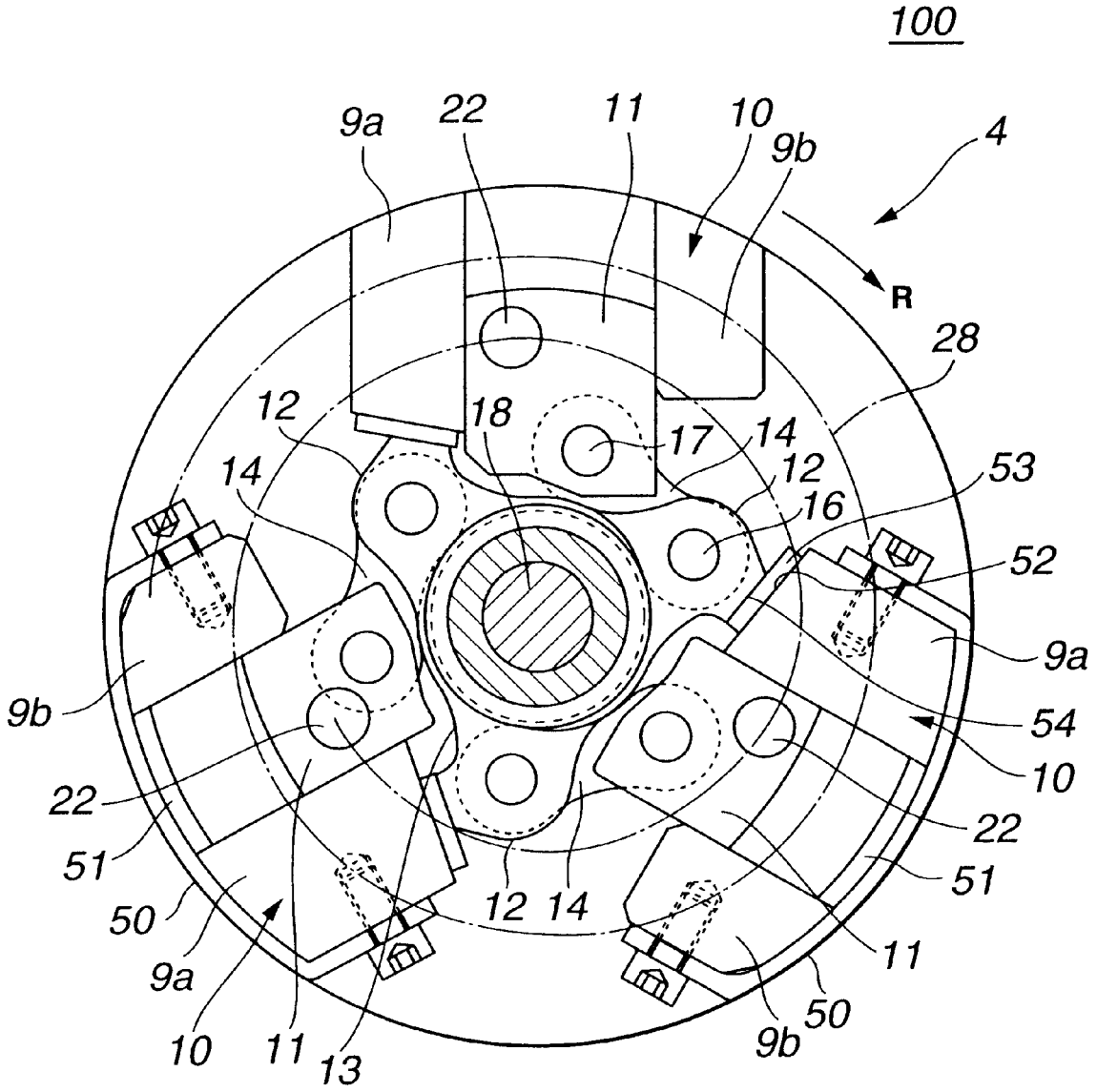
FIG. 3 is a view similar to FIG. 2, but showing the most-advanced angular position of the camshaft relative to the drive plate.

In FIGS. 2 and 3, denoted by numeral 50 are stoppers for stopping excessive outer radial movement of the sliding members 11, and denoted by numeral 51 are shock absorbers attached to the stoppers 50 for absorbing the shock produced when the sliding members 11 run against the stoppers 50. That is, when the camshaft 1 is turned to the most-retarded angular position relative to the drive plate 2 as is shown in FIG. 2, the sliding members 11 abut against the stoppers 50. The shock absorbers 51 are constructed of a rubber material such as NBR (acrylonitrile-butadiene rubber), fluoro rubber, acrylic rubber or the like.

Denoted by numeral 54 are stopping edges of the lever shaft 13 which, when the lever shaft 13 is rotated to its one terminal end relative to the drive plate 2, are brought into contact with leading edges 52 of the guide walls 9*a* thereby to suppress excessive rotation of the lever shaft 13 relative to the drive plate 2, and denoted by numeral 53 are shock absorbers attached to the leading edges 52 for absorbing a shock produced when the stopping edges 54 run against the leading edges 52. That is, when the camshaft 1 is turned to the most-advanced angular position relative to the drive plate 2 as is shown in FIG. 3, the stopping edges 54 abut against the leading edges 52. The shock absorbers 53 are constructed of the above-mentioned rubber material.

In the following, operation of the valve timing control device 100 of the first embodiment will be described with reference to the drawings.

For ease of understanding, the description will be commenced with respect to a condition which is provided at the time when an associated engine is just started and/or under idling operation.

Under such condition, the first and second electromagnetic brakes 26 and 27 are both deenergized by an instruction signal from the controller 7. For the above-mentioned reason, the annular friction pad 37 of the second electromagnetic brake 27 is in a frictional engagement with the brake flange 34. Accordingly, to the sun gear 30 of the planetary gear unit 25, there is applied a certain braking force, so that together with the drive plate 2 (viz., timing sprocket 3), the guide plate 24 is rotated in a speed increasing direction, and thus the sliding members 11 are kept at their radially outermost positions. As a result, as is understood from FIG. 2, the lever shaft 13 (or camshaft 1), which is pivotally connected to the sliding members 11 through the link arms 14 and the radial levers 12, is kept in the most-retarded angular position relative to the drive plate 2.

Accordingly, under this condition, the phase of rotation of the camshaft 1 is controlled to the most-retarded side, which promotes a stable running of the engine as well as a saved fuel consumption of the engine.

When now the engine is shifted to a normal operation condition, the controller 7 energizes both the first and second electromagnetic brakes 26 and 27. Upon this, the friction pad 37 of the first electromagnetic brake 26 is brought into contact with the guide plate 24 and at the same time, the friction pad 37 of the second electromagnetic brake 27 is released from the brake flange 34. Thus, the sun gear 30 becomes free and the guide plate 24 becomes applied with a braking force, so that the guide plate 24 makes a rotation relative to the drive plate 2 in a speed reducing side. As a result, the rolling ball 22 of each sliding member 11 is forced to move in and along the spiral guide groove 28 toward the center of the same, and thus, each sliding member 11 is moved toward the radially innermost position, as shown in FIG. 3. During this movement, the link arms 14 pivotally connected to the sliding members 11 push the respective radial levers 12 forward in a rotation direction, so that the lever shaft 13 (or camshaft 1) is shifted to the most-advanced angular position relative to the drive plate 2.

When the camshaft 1 is turned to the most-advanced angular position relative to the drive plate 2, the stopping edges 54 of the lever shaft 13 are brought into abutment with the leading edges 52 of the guide walls 9*a* thereby to suppress further turning of the camshaft 1 in the advancing direction. Under this condition, the phase of rotation of the camshaft 1 is controlled to the most-advanced side, which promotes a power generation of the engine.

When, now, it is intended to control the phase of rotation of the camshaft 1 toward a retarded side, the first and second electromagnetic brakes 26 and 27 are deenergized by the controller 7. With this, the friction pad 37 of the first electromagnetic brake 26 is released from the guide plate 24 and at the same time, the friction pad 37 of the second electromagnetic brake 37 is brought into frictional contact with the brake flange 34. With this action, the sun gear 30 of the planetary gear unit 25 is applied with a braking force, and thus, the guide plate 24 is rotated in a speed increasing direction moving the sliding members 11 toward their radially outermost positions. As a result, as is understood from FIG. 2, the link arms 14 pull the radial levers 12, causing the camshaft 1 (or lever shaft 13) to take the retarded angular position relative to the drive plate 2.

In the valve timing control device 100, the guide plate 24 as a so-called intermediate rotation member is rotated in a speed increasing or reducing direction by the work of the planetary gear unit 25 and the work of the first and second electromagnetic brakes 26 and 27, and the rotation of the guide plate 24 induces the radial movement of the sliding members 11. Accordingly, for each of the first and second electromagnetic brakes 26 and 27, there is needed only a braking force that overcomes a sum of an operation resistance of the sliding members 11 and a friction resistance of a power transmission train from the braking force receiving portions to the sliding members 11. That is, the first and second electromagnetic brakes 26 and 27 can serve as an actuator for turning the guide plate 24 in the speed increasing or reducing direction in cooperation with rotation of the drive plate 2. Since these two brakes 26 and 27 are so constructed that a braking force produced by one of the brakes 26 and 27 does not cancel a braking force produced by the other of the brakes 26 and 27, the braking force produced by each brake 26 or 27 can be set or determined by only considering the sum of the operation resistance of the sliding members 11 and the friction resistance of the power transmission train.

Accordingly, the electromagnetic force needed by the first and second electromagnetic brakes 26 and 27 can be relatively small and thus electric power consumption of the brakes 26 and 27 can be reduced, which promotes a saving of the electric power consumed by the associated motor vehicle.

Furthermore, in the valve timing control device 100, the sun gear 30 of the planetary gear unit 25 is provided with the annular brake flange 34 which extends outward toward the pinion gears 33 to constitute a braked face to which the braking force of the second electromagnetic brake 27 is applied. Thus, the second electromagnetic brake 27 can be compactly installed in a limited space defined in front of the planetary gear unit 25. If the area of the braked face to which the annular friction pad 37 contacts is increased, the braking force of the brake 27 can be increased.

Furthermore, in the valve timing control device 100 of this first embodiment, only the magnetic force generating core 35 of the second electromagnetic brake 27 is constantly biased toward the brake flange 34 by the spring 38, and thus when the two electromagnetic brakes 26 and 27 are deenergized, a certain braking force is applied to the sun gear 30 through the brake flange 34. Under this, the camshaft 1 is turned or shifted in a retarding direction relative to the drive plate 2, as has been described hereinafore. Accordingly, when an electric system of the engine fails to operate causing OFF condition of the two electromagnetic brakes 26 and 27, the open/close timing of the intake valves 71 (or engine valves) is shifted toward a retarded side. This means that starting of the engine can be carried out with the retarded open/close timing of the intake valves 71. As is known, a retarded open/close timing of the engine valves is suitable to the engine starting.

In the valve timing control device 100 of the first embodiment, the planetary gear unit 25 is employed, which comprises toothed rotating members 30, 31 and 33. However, if desired, in place of such gear unit 25, a unit including toothless rotating members which correspond to the toothed rotating members 30, 31 and 33 may be used. In this unit, a frictional contact is carried out between the toothless rotating members.

Figure 6:
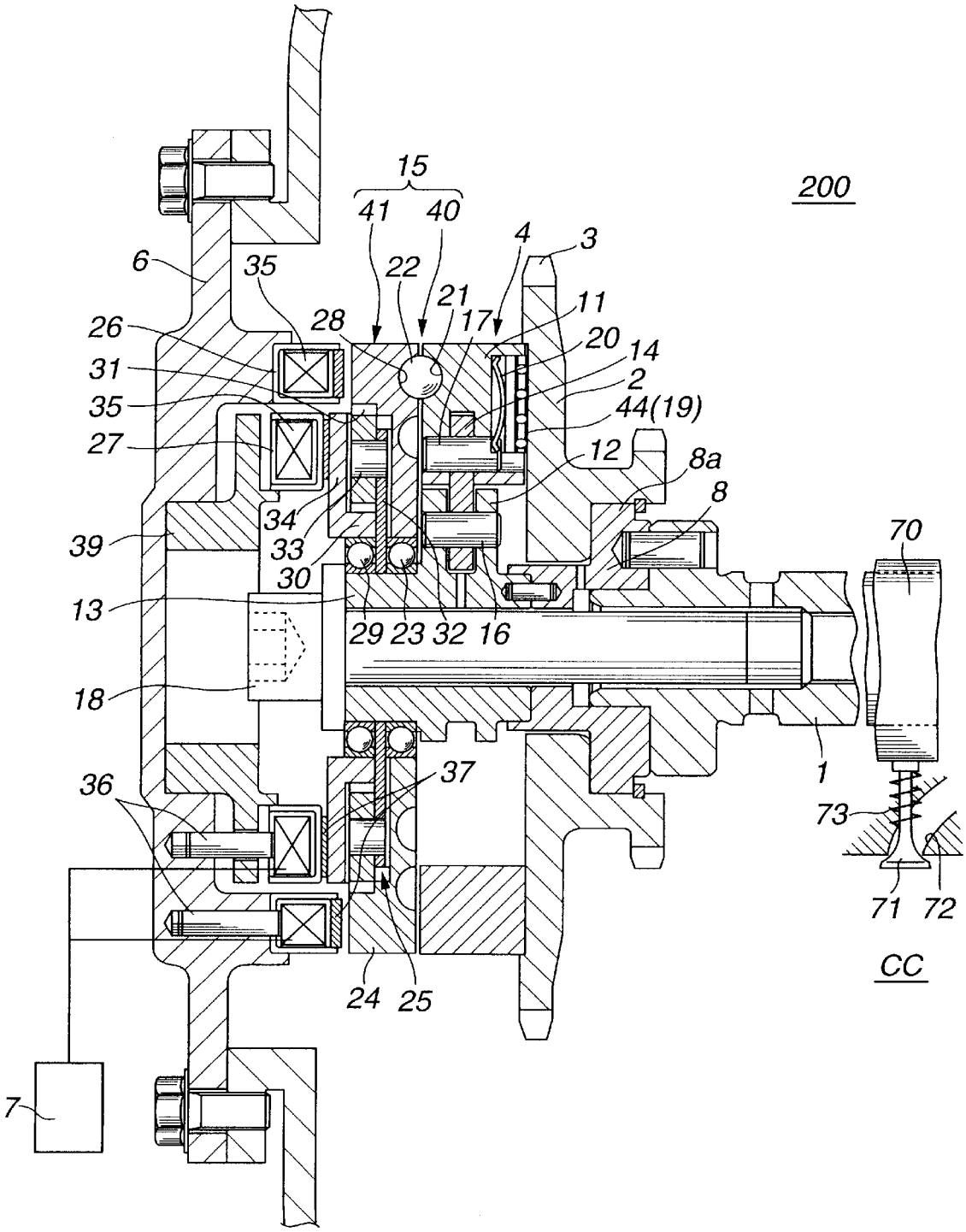
FIG. 6 is a view similar to FIG. 1, but showing a valve timing control device which is a second embodiment of the present invention.

Referring to FIG. 6, there is shown a valve timing control device 200 which is a second embodiment of the present invention.

Since the second embodiment 200 is similar to the above-mentioned first embodiment 100, only parts or portions which are different from those of the first embodiment 100 will be described in detail in the following. Substantially same parts as those of the first embodiment 100 are denoted by the same numerals in FIG. 6.

As shown in FIG. 6, in this second embodiment 200, there is no means which corresponds to the spring 38 of the first embodiment 100.

That is, in this second embodiment 200, when the first and second electromagnetic brakes 26 and 27 are both in OFF condition, the friction pads 37 of the brakes 26 and 27 are released from the guide plate 24 and the brake flange 34 of the sun gear 30.

In order to shift the open/close timing of the intake valves 71 toward a retarded side, the second electromagnetic brake 27 is turned ON (viz., energized) and at the same time the first electromagnetic brake 26 is turned OFF (viz., deenergized). While, in order to shift the open/close timing of the intake valves 71 toward an advanced side, the first electromagnetic brake 26 is turned ON and at the same time the second electromagnetic brake 27 is turned OFF.

In the valve timing control device 200 of this second embodiment, once the intake valves 71 are set at a new open/close timing, both the first and second electromagnetic brakes 26 and 27 can be turned OFF, and thus, the electric power consumption is reduced.

Figure 7:
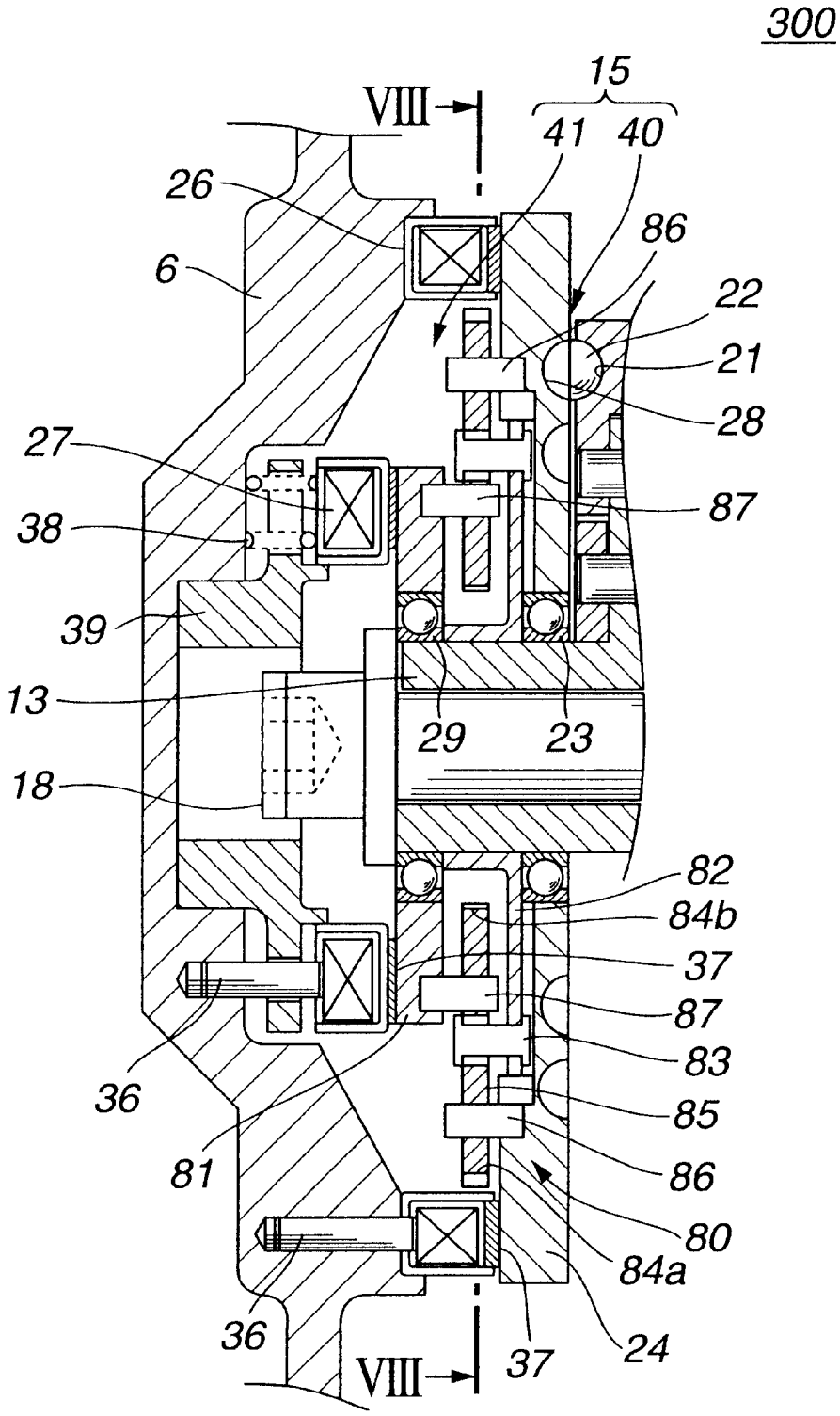
FIG. 7 is a view also similar to FIG. 1, but showing a valve timing control device which is a third embodiment of the present invention.
Figure 8:
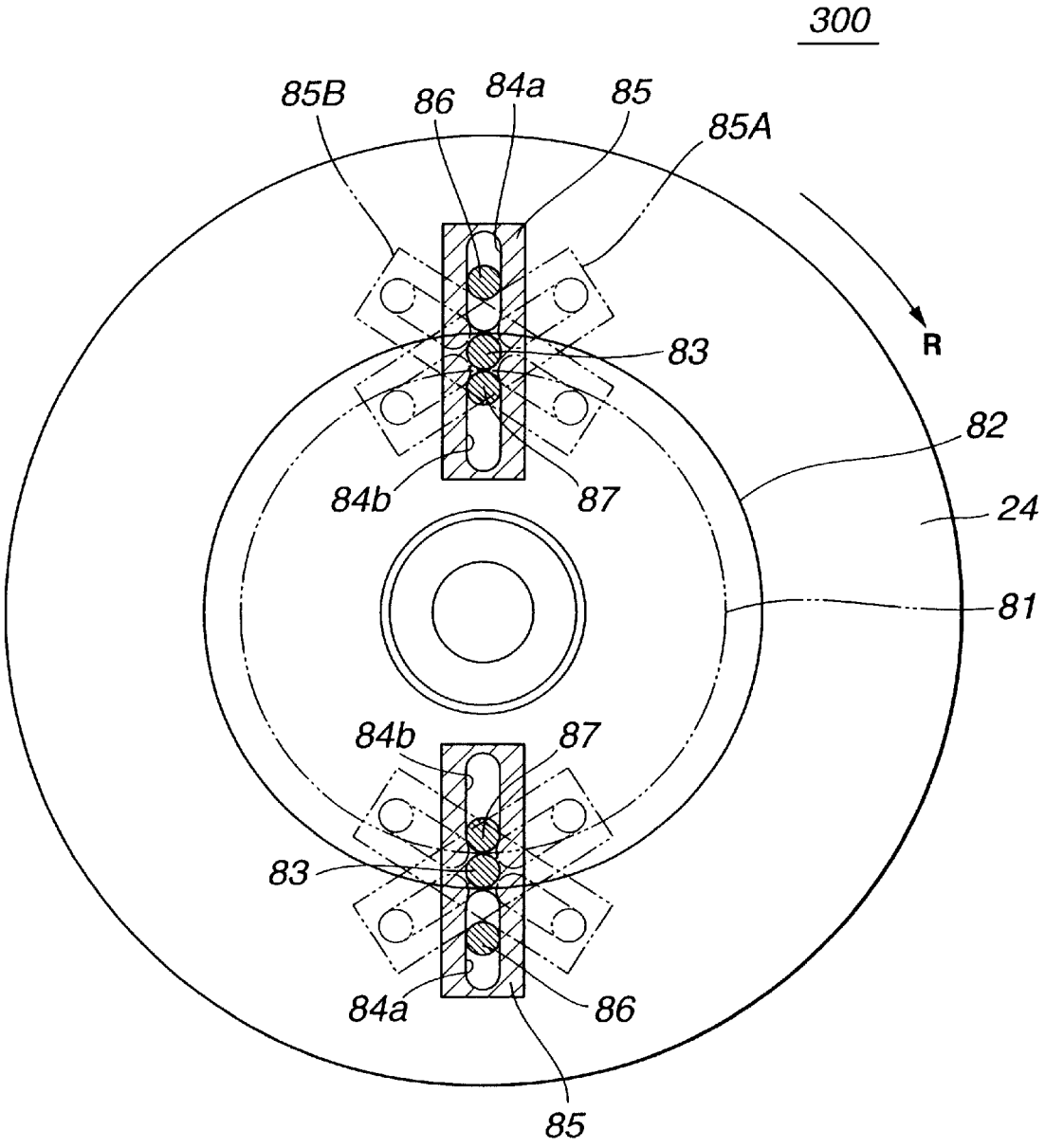
FIG. 8 is a sectional view taken along the line "VIII—VIII" of FIG. 7.

Referring to FIGS. 7 and 8, there is shown a valve timing control device 300 which is a third embodiment of the present invention.

Similar to the above-mentioned second embodiment 200, substantially same parts as those of the first embodiment 100 are denoted by the same numerals in FIGS. 7 and 8.

In this third embodiment 300, in place of the planetary gear unit 25 employed in the first embodiment 100, a slide link mechanism 80 is employed.

The slide link mechanism 80 comprises a circular brake plate 81 which is rotatably disposed on a front end portion of the lever shaft 13 through a bearing 29, a circular carrier plate 82 which is secured to the lever shaft 13 at a position between the bearing 29 and another bearing 23, two shafts 83 which are provided at diametrically opposed portions of the circular carrier plate 82, each shaft being directed toward a VTC cover (6, see FIG. 1), two slide links 85 which are pivotally and respectively held by the two shafts 83 at their middle portions, each slide link having two slits 84*a* and 84*b* which extend outward from an area of the middle portion, two outside pins 86 which are secured to diametrically opposed portions of the circular guide plate 24 and slidably engaged with the slits 84*a* respectively, and two inside pins 87 which are secured to diametrically opposed portions of the brake plate 81 and slidably engaged with the slits 84*b* respectively.

As is known to those skilled in the art, operation of the slide link mechanism 80 having the above-mentioned construction is similar to that of the above-mentioned planetary gear unit 25. That is, a unit including the brake plate 81 and the two inside pins 87 correspond to the sun gear (30), a unit including the guide plate 24 and the two outside pins 86 corresponds to the ring gear (31), and the slide links 85 correspond to the pinion gears (33).

That is, when, with the brake plate 81 being free due to deenergization of the second electromagnetic brake 27, the slide links 85 are turned about an axis of the lever shaft 13 together with the carrier plate 82, the inside and outside pins 87 and 86 (and guide plate 24) are turned together with the carrier plate 82 at the same speed. When, under this condition, the brake plate 81 is applied with a braking force from the second electromagnetic brake 27, turning of the inside pins 87 is retarded. The retarded turning of the inside pins 87 causes the pins 87 to slide in the slits 84*b* of the slide links 85 resulting in that each slide link 85 is swung rightward in FIG. 8, that is, in a rotation direction "R" of the drive plate (2, see FIG. 1) to a position indicated by 85A. Thus, the outside pins 86 are pushed in the direction of the arrow "R" while sliding in the slits 84*a* of the slide links 85, so that the guide plate 24 is turned or shifted to an advanced side with respect to the drive plate 2.

While, when the guide plate 24 is applied with a braking force from the first electromagnetic brake 26, turning of the outside pins 86 becomes retarded as compared with that of the carrier plate 82, and thus each slide link 85 is swung in an opposite direction to a position indicated by 85B.

In the valve timing control device 300 of this third embodiment, the slide link mechanism 80 is employed, which is constructed simple as compared with the planetary gear unit 25. Thus, the device 300 can be made at a lower cost.

As has been described in the foregoing, in the present invention, by using a braking force produced by one electromagnetic brake, the camshaft 1 is turned or shifted toward an advanced side, and by using a braking force produced by the other electromagnetic brake, the camshaft 1 is turned or shifted toward a retarded side. Thus, the braking force needed by each electromagnetic brake is only a force that overcomes a sum of an operation resistance of the sliding members 11 and a friction resistance of a power transmission train from the braking force receiving portions to the sliding members 11. Accordingly, the magnetic force produced by each electromagnetic brake can be reduced and thus electric power consumption of the brakes can be reduced.

In case of the first and second embodiments 100 and 200 wherein a planetary gear unit 25 is used for actuating the circular guide plate 24 relative to each of the drive plate 2 (or crankshaft) and the camshaft 1, the brake flange 34 extending radially outward from the sun gear 30 can have an increased area to which the braking force from the second electromagnetic brake 27 is applied. This means facility with which the brake 27 is laid out.

As is described in the part of the first embodiment 100, when the device 100 is so arranged as to retard the open/close timing of the intake valves 71 when the two electromagnetic brakes 26 and 27 are turned OFF, engine starting is assuredly made even when the electric system of the engine fails to operate.

The entire contents of Japanese Patent Application 2001-24079 filed Jan. 31, 2001 are incorporated herein by reference.

Although the invention has been described above with reference to the embodiments of the invention, the invention is not limited to such embodiments as described above. Various modifications and variations of such embodiments may be carried out by those skilled in the art, in light of the above description.

What is claimed is:

1. A valve timing control device of an internal combustion engine, comprising:

a drive rotation member rotated about a given axis by a crankshaft of the engine;

a driven rotation member rotated about said given axis together with a camshaft of the engine;

a relative rotation angle control mechanism through which said drive and driven rotation members are coaxially connected, said relative rotation angle control mechanism having a movable control member which, when radially moved by receiving an operation force, varies a relative rotation angle between said drive and driven rotation members; and an actuation device which applies an operation force to said movable control member, said actuation device comprising a first electromagnetic brake which applies an operation force to said movable control member to cause a rotation of said driven rotation member to be shifted in one of advancing and retarding directions with respect to a rotation of said drive rotation member; and a second electromagnetic brake which applies an operation force to said movable control member to cause the rotation of said driven rotation member to be shifted in the other of the advancing and retarding directions with respect to the rotation of said drive rotation member, said relative rotation angle control mechanism being so arranged that when both said first and second electromagnetic brakes of said actuation device become deenergized, a certain relative rotation angle is provided between said drive and driven rotation members, which is suitable for starting of the engine.

2. A valve timing control device of an internal combustion engine, comprising:

a drive rotation member rotated about a given axis by a crankshaft of the engine;

a driven rotation member rotated about a given axis together with a camshaft of the engine;

a relative rotation angle control mechanism through which said drive and driven rotation members are coaxially connected, said relative rotation angle control mechanism having a movable control member which, when applied with an operation force from an actuation device, varies a relative rotation angle between said drive and driven rotation members, said actuation device comprising:

a first electromagnetic brake which applies an operation force to said movable control member to cause a rotation of said driven rotation member to be shifted in one of advancing and retarding directions with respect to a rotation of said drive rotation member; and a second electromagnetic brake which applies an operation force to said movable control member to cause the rotation of said driven rotation member to be shifted In the other of the advancing and retarding directions with respect to the rotation of said drive rotation member;

in which said relative rotation angle control mechanism comprises:

an intermediate rotation member rotatable about said given axis relative to both said drive and driven rotation members;

an operation converging mechanism which, when said intermediate rotation member rotates, varies a phase of rotation of said driven rotation member with respect to said drive rotation member in accordance with a direction and a rotation angle in and by which said intermediate rotation member rotates;

a speed reducing brake member which, when applied with a braking force from said first electromagnetic brake, reduces a rotation speed of said intermediate rotation member; and a speed increase/decrease mechanism having a speed increasing brake member which, when applied with a braking force from said second electromagnetic brake, increases the rotation speed of said intermediate rotation member.

3. A valve timing control device as claimed in claim 2, in which said speed increase/decrease mechanism comprises said first and second electromagnetic brakes, and a planetary gear unit.

4. A valve timing control device as claimed in claim 3, in which one of a ring gear and a sun gear of said planetary gear unit constitutes said speed reducing braking member, and the other of said ring gear and said sun gear constitutes said speed increasing brake member.

5. A valve timing control device as claimed in claim 4, in which said sun gear is provided with a radially extending brake flange to which an electromagnetic force of said second electromagnetic brake is applicable.

6. A valve timing control device as claimed in claim 2, in which said relative rotation angle control mechanism is constructed to vary the relative rotation angle between said drive and driven rotation members in accordance with a radial movement of said movable control member, and in which said intermediate rotation member is formed with a spiral guide, said movable control member being slidably engaged with said spiral guide to constitute said operation converging mechanism.

7. A valve timing control device as claimed in claim 6, in which said movable control member is radially movably held by one of said drive and driven rotation members, and in which said movable control member is connected through a link to a given portion of one of said drive and driven rotation members, said given portion being positioned away from said given axis in a radial direction.

8. A valve timing control device as claimed in claim 2, in which said relative rotation angle control mechanism is so arranged that when both said first and second electromagnetic brakes of said actuation device become deenergized, a certain relative rotation angle is provided between said drive and driven rotation members which is suitable for starting of the engine.

9. A valve timing control device as claimed in claim 8, in which one of said first and second electromagnetic brakes is so arranged as to provide the suitable relative rotation angle between the drive and driven rotation members when applying a braking force to said speed reducing brake member.

10. A valve timing control device as claimed in claim 9, in which said one of said first and second electromagnetic brakes comprises a friction surface, and in which said one of said first and second electromagnetic brakes applies a braking force to said speed reducing brake member when said friction surface contacts said brake member and releases said brake member from the braking force when said friction surface is released from said brake member.

11. A valve timing control device as claimed in claim 10, in which said one of said first and second electromagnetic brakes further comprises a spring which is arranged to constantly bias said friction surface toward said speed reducing brake member, so that when said one of said first and second electromagnetic brakes becomes deenergized, said friction surface becomes into contact with said brake member due to the force of said spring.

12. A valve timing control device of an internal combustion engine, comprising:

a drive rotation member rotated about a given axis by a crankshaft of the engine;

a driven rotation member rotated about said given axis together with a camshaft of the engine;

a relative rotation angle control mechanism through which said drive and driven rotation members are coaxially, connected, said relative rotation angle control mechanism having a movable control member which, when radially moved by receiving an operation force, varies a relative rotation angle between said drive and driven rotation members; and an actuation device which applies an operation force to said movable control member, said actuation device comprising a first electromagnetic brake which applies an operation force to said movable control member to cause a rotation of said driven rotation member to be shifted in one of advancing and retarding directions with respect to a rotation of said drive rotation member; and a second electromagnetic brake which applies an operation force to said movable control member to cause the rotation of said driven rotation member to be shifted in the other of the advancing and retarding directions with respect to the rotation of said drive rotation member, said relative rotation angle control mechanism comprising an intermediate rotation member rotatable about said given axis relative to both said drive and driven rotation members, said intermediate rotation member being formed with a spiral guide with which said movable control member is slidably engaged, so that rotation of said intermediate rotation member induces the radial movement of said movable control member.

13. A valve timing control device of an internal combustion engine, comprising:

a drive rotation member rotated about a given axis by a crankshaft of the engine;

a driven rotation member rotated about said given axis together with a camshaft of the engine;

a relative rotation angle control mechanism through which said drive and driven rotation members are coaxially connected, said relative rotation angle control mechanism having a movable control member which, when radially moved by receiving an operation force, varies a relative rotation angle between said drive and driven rotation members; and an actuation device which applies an operation force to said movable control member, said actuation device comprising a first electromagnetic brake which applies an operation force to said movable control member to cause a rotation of said driven rotation member to be shifted in one of advancing and retarding directions with respect to a rotation of said drive rotation member; and a second electromagnetic brake which applies an operation force to said movable control member to cause the rotation of said driven rotation member to be shifted in the other of the advancing and retarding directions with respect to the rotation of said drive rotation member, said relative rotation angle control mechanism comprising:

an intermediate rotation member rotatable about said given axis relative to both said drive and driven rotation members, said intermediate rotation member being formed with a spiral guide with which said movable control member is slidably engaged, so that rotation of said intermediate rotation member induces the radial movement of said movable control member; and a link through which said movable control member is linked to a given portion of said driven rotation member, said given portion being positioned away from said given axis in a radial direction.

* * * * *